US005187334A

United States Patent [19]

Abbott et al.

[11] Patent Number: 5,187,334

[45] Date of Patent: Feb. 16, 1993

[54] ACOUSTIC MUFFLER WITH ONE-PIECE HOUSING

[75] Inventors: James R. Abbott, Jackson; Benny J. Snider, Brooklyn, both of Mich.

[73] Assignee: Tennessee Gas Pipeline Company, Lincolnshire, Ill.

[21] Appl. No.: 751,876

[22] Filed: Aug. 28, 1991

Related U.S. Application Data

[62] Division of Ser. No. 546,919, Jul. 2, 1990.

[51] Int. Cl.[5] ..... F01N 1/08

[52] U.S. Cl. ..... 181/265; 181/268; 181/276; 181/282

[58] Field of Search ..... 181/227, 228, 238, 239, 181/264, 265, 266, 268, 269, 272, 275, 282

[56] References Cited

U.S. PATENT DOCUMENTS

| | | | |
|---|---|---|---|
| 1,433,890 | 10/1922 | Johnson et al. | 72/367 |
| 2,005,306 | 6/1935 | Wallis | 72/367 |
| 3,209,438 | 10/1965 | Brown | 29/890.08 |
| 3,220,507 | 11/1965 | Jettinghoff | 181/265 |
| 3,289,785 | 12/1966 | Walker | 181/265 |
| 3,315,761 | 4/1967 | Selig | 29/890.08 |
| 3,648,803 | 3/1972 | Heath et al. | 181/48 |
| 3,841,431 | 10/1974 | Hetherington | 29/890.08 |
| 4,239,733 | 12/1980 | Foster et al. | 422/179 |
| 4,269,807 | 5/1981 | Bailey et al. | 422/179 |
| 4,335,078 | 6/1982 | Ushijima et al. | 422/179 |
| 4,345,373 | 8/1982 | Lacaze, Jr. | 82/367 |
| 4,486,932 | 12/1984 | Hall et al. | 29/890.08 |
| 4,559,205 | 12/1985 | Hood | 422/180 |
| 5,055,274 | 10/1991 | Abbott | 181/282 X |

FOREIGN PATENT DOCUMENTS

| | | | |
|---|---|---|---|
| 2260021 | 6/1974 | Fed. Rep. of Germany | 72/367 |
| 3139186 | 4/1983 | Fed. Rep. of Germany | 181/227 |
| 2335696 | 12/1975 | France | 181/227 |
| 310171 | 4/1929 | United Kingdom | 72/367 |

*Primary Examiner*—Michael L. Gellner
*Assistant Examiner*—Khanh Dang
*Attorney, Agent, or Firm*—Harness, Dickey & Pierce

[57] ABSTRACT

A muffler of the type used to attenuate exhaust gas noise in exhaust systems of automobiles, trucks, or the like, particularly characterized by a gas flow conduit which is axially slotted and laterally flattened to form a closure and a pair of openings axially inward of the closure, wherein the end walls of the shell are pressed into engagement with the conduit ends to close the conduit and support the conduit.

68 Claims, 7 Drawing Sheets

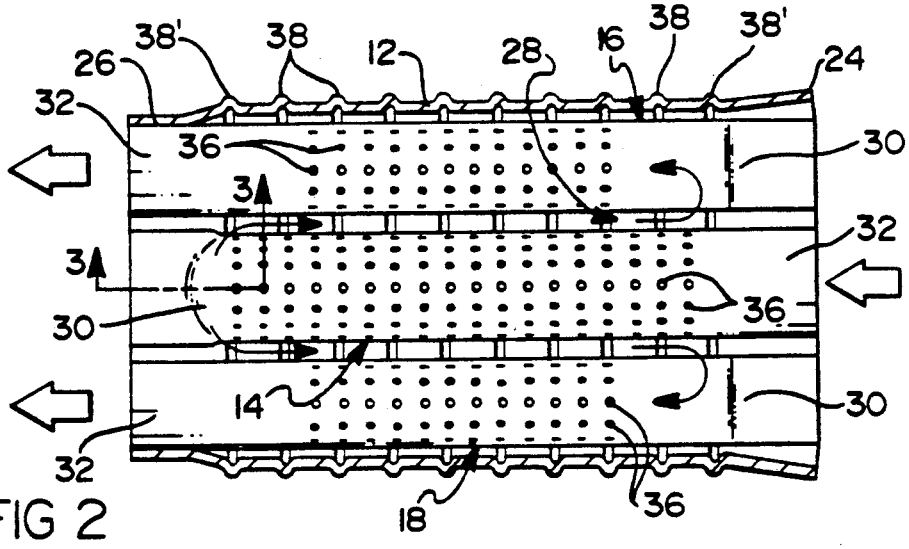
FIG 2
FIG 3
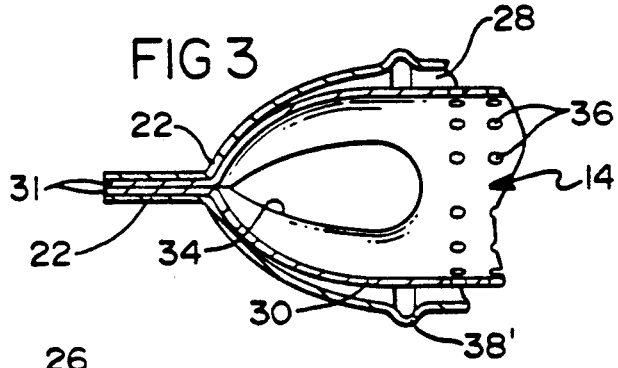
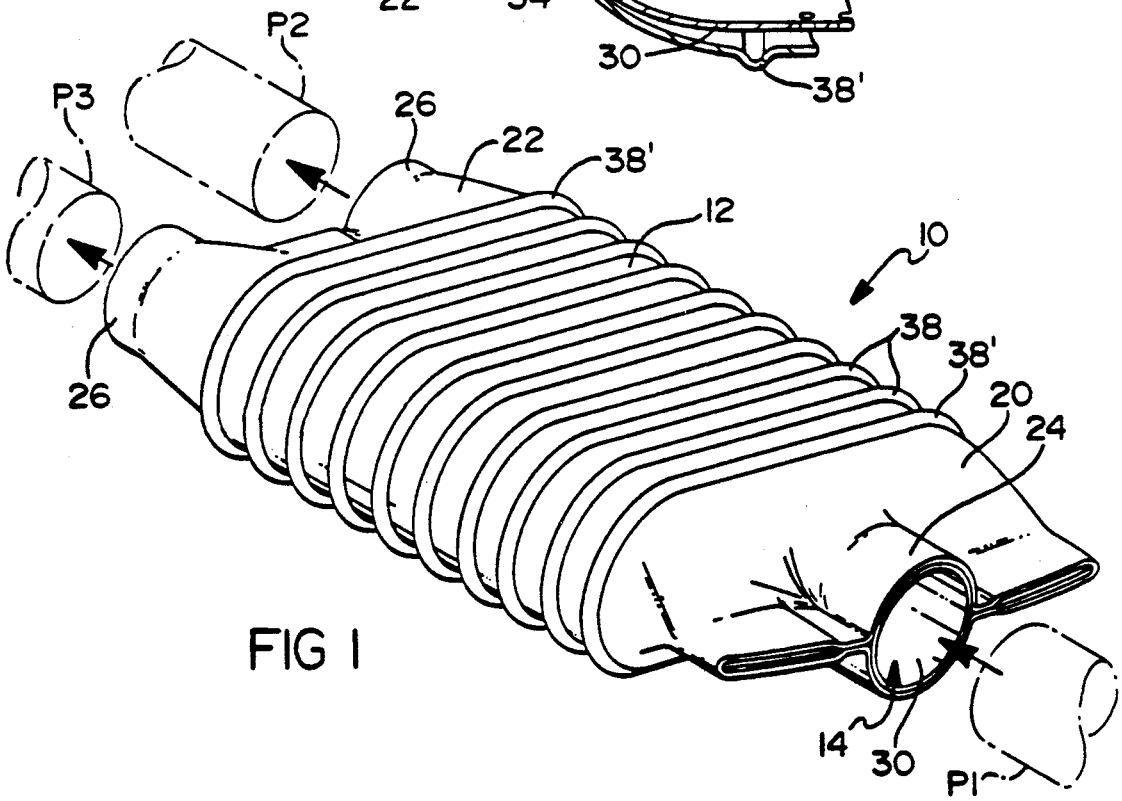
FIG 1

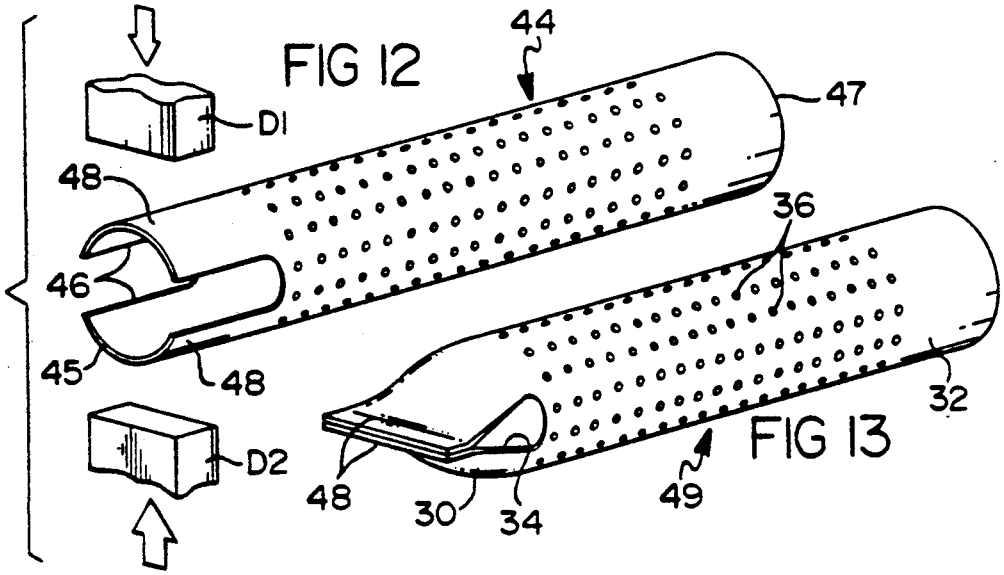
FIG 12
44
47
D1
48
46
45
48
D2
36
32
FIG 13
48
30
34
49
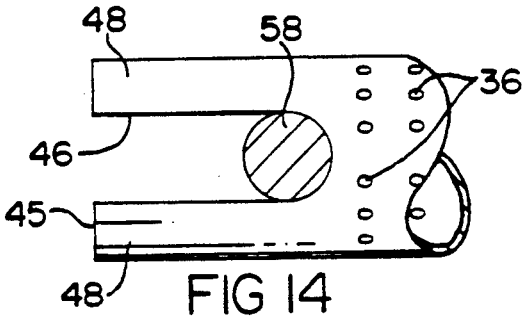
48
58
36
46
45
48
FIG 14
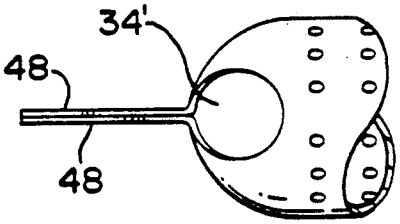
34'
48
48
FIG 15
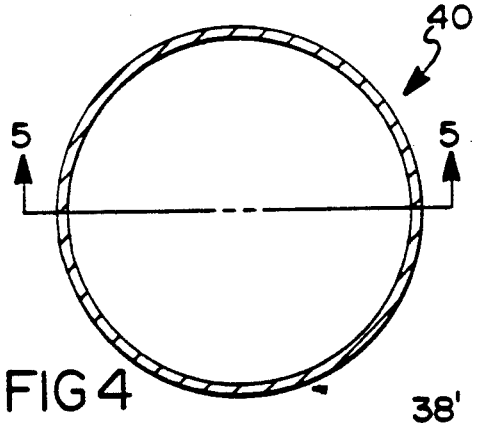
40
5
5
FIG 4
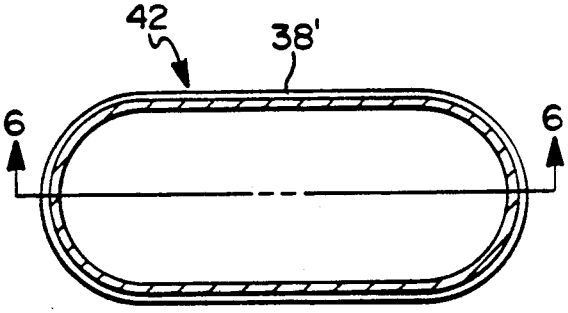
42
38'
6
6
FIG 7
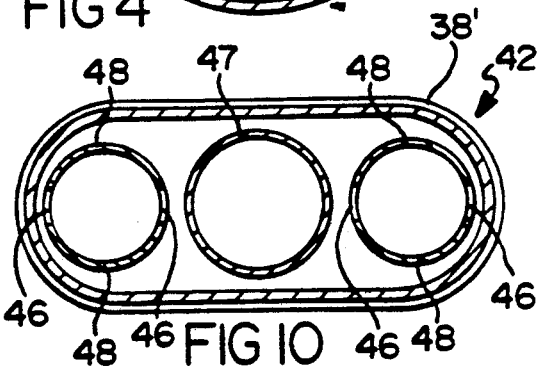
38'
48
47
48
42
46
48
46
46
48
FIG 10
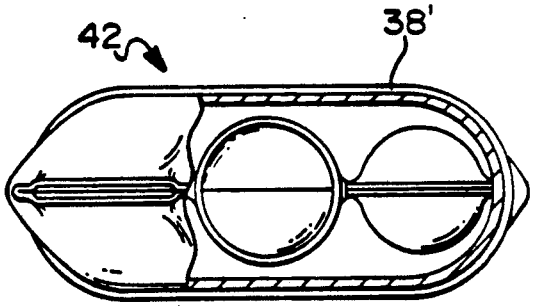
42
38'
FIG 11

FIG 16
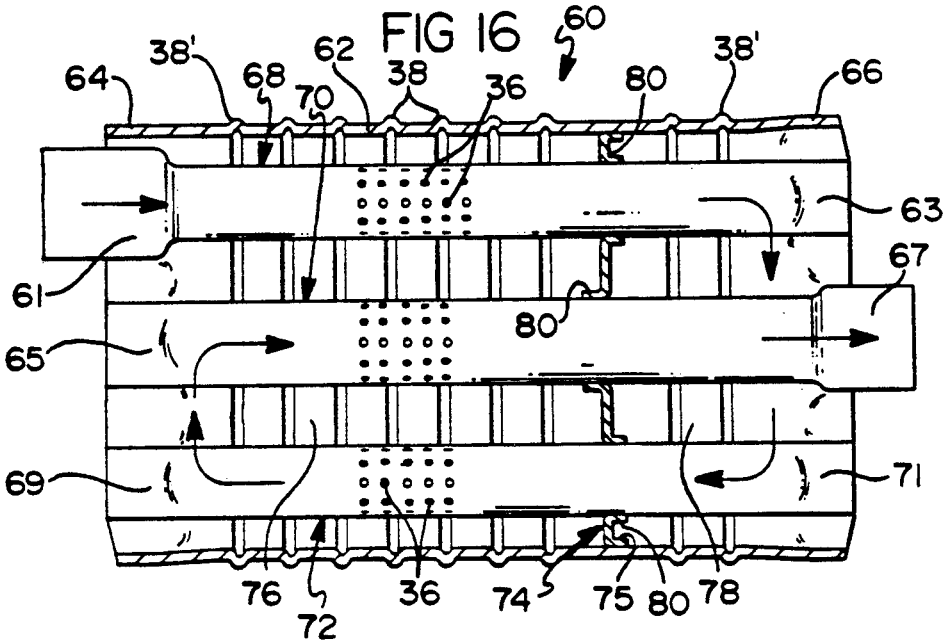
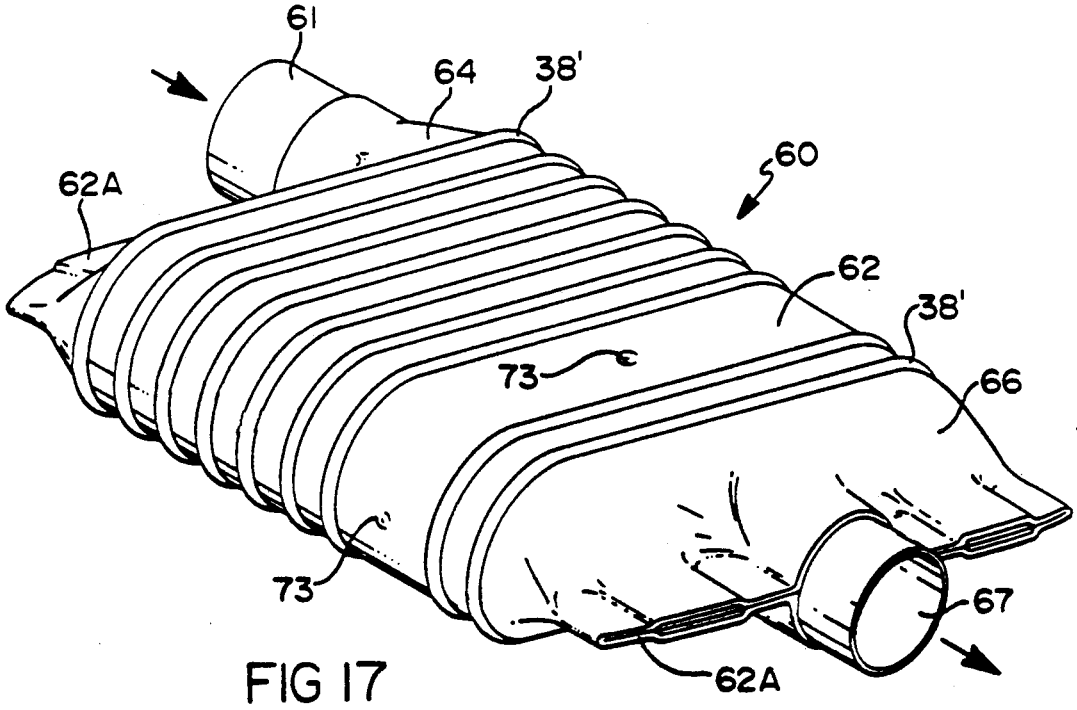
FIG 17

FIG 18
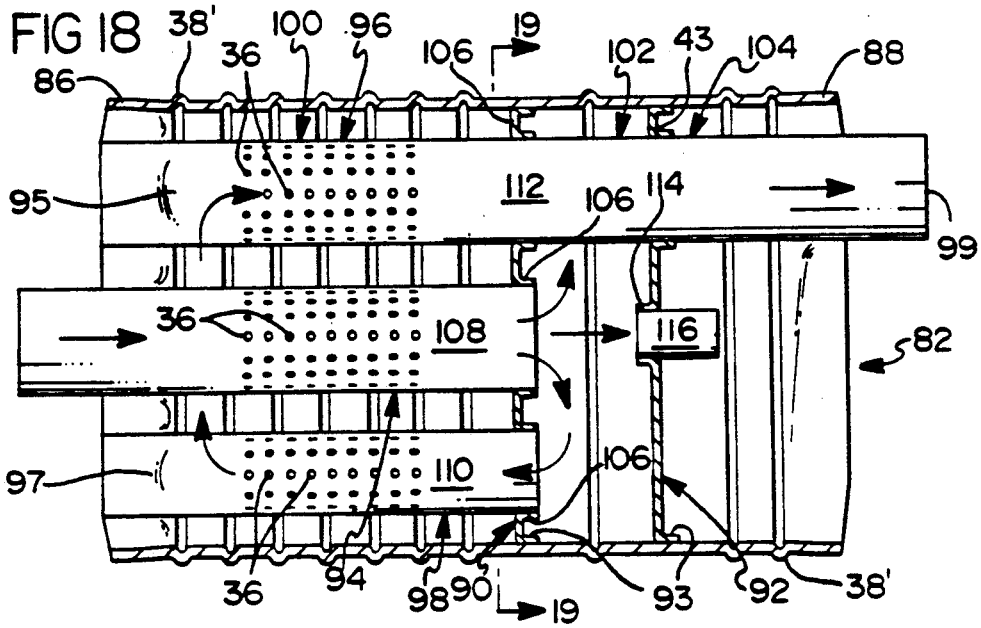
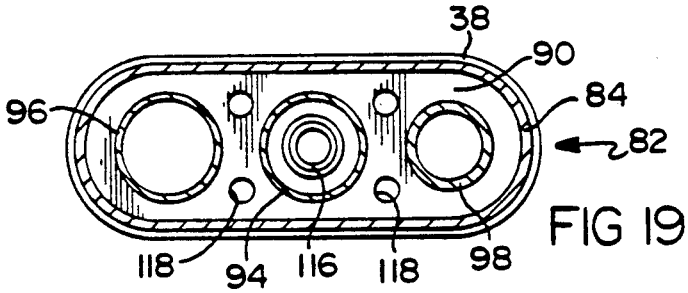
FIG 19
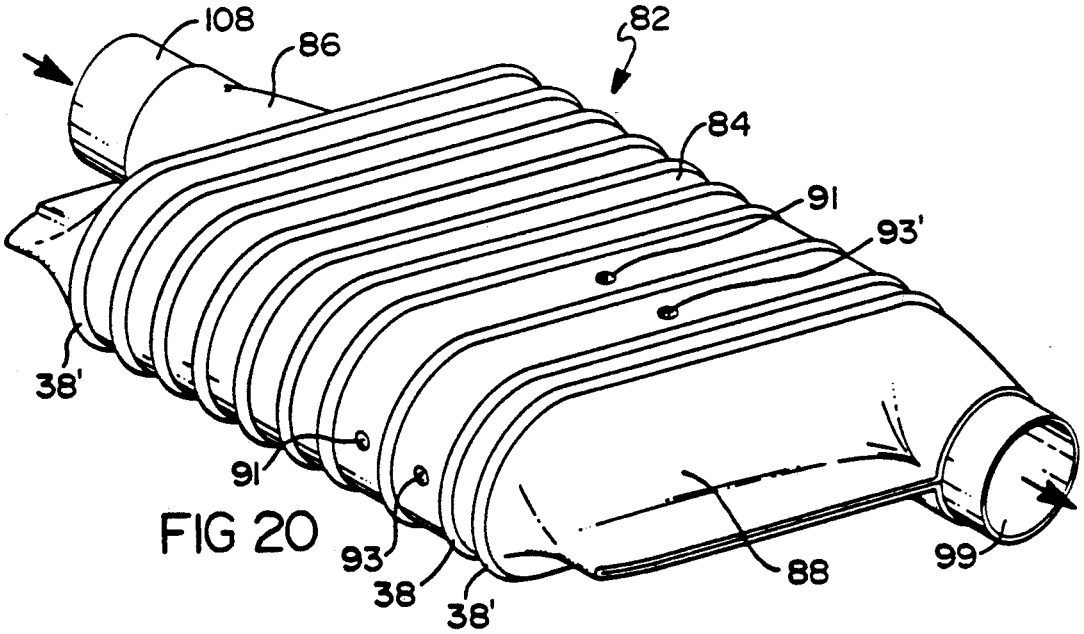
FIG 20

FIG 21
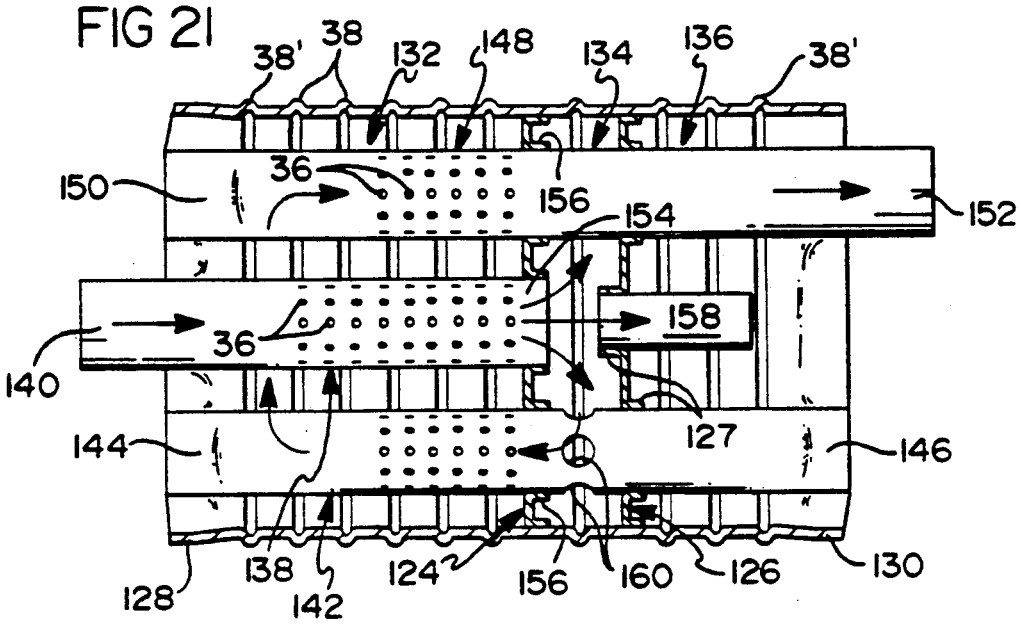
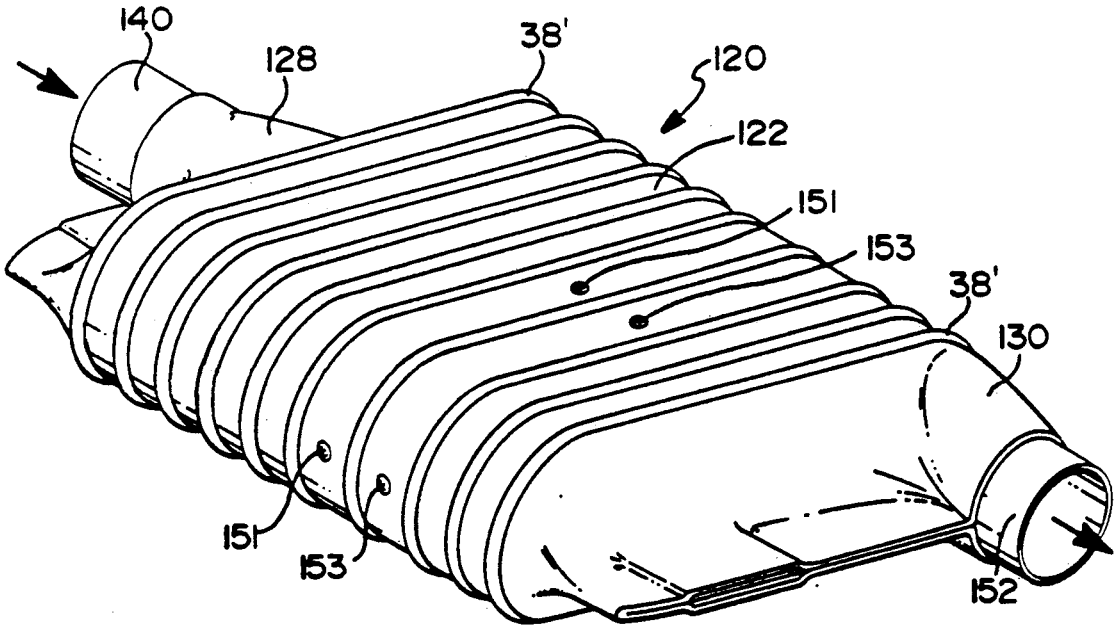
FIG 22

ACOUSTIC MUFFLER WITH ONE-PIECE HOUSING

This is a division of U.S. patent application Ser. No. 546,919, filed Jul. 2, 1990, entitled "Acoustic Muffler with One-Piece Housing".

This invention relates to acoustic mufflers for use in the exhaust systems of automobiles, trucks, and the like to attenuate undesired exhaust gas sounds and noise.

Typically, a housing for a commercially acceptable muffler comprises a metal tube of circular or oval cross section with separate stamped metal headers mechanically roll-seamed or welded in and closing the opposite ends of the tube whereby the housing is composed of three pieces This muffler typically has internal gas flow members which are supported on transverse metal partitions secured to the inside of the housing.

It is an important purpose of the present invention to provide an exhaust gas sound attenuation device, i.e., an acoustic muffler for motor vehicles, such as passenger automobiles, trucks, etc., which has a one-piece housing; that is, a muffler in which the conventional inlet and outlet end headers have been eliminated It is also an important purpose of the invention to provide a muffler in which one or more of the usual internal partitions is eliminated, this being possible because of a novel gas flow conduit construction provided by the invention.

Another purpose of the invention is to provide a method of making a muffler that uses fewer end headers and/or internal partitions than would a corresponding muffler of conventional construction.

A muffler according to the invention is able to use an internal sound attenuation structure embodying essentially the same acoustic principles and techniques as one having a three-piece housing or more internal partitions. It therefore is capable of performing at least as well as one having a prior type housing or internal structure but has a construction that weighs less, is less resistant to the flow of air past it, is inherently more economical to produce, yet is capable of mass manufacture in the large volumes required to supply original equipment manufacturers of automobiles and trucks for factor installation in the exhaust systems of these vehicles.

The invention provides a one-piece housing by pinching together opposite sides of the ends of a tubular housing. Preferably, this is facilitated by providing the ends of the housing with auxiliary sources of metal which may be in the form of outwardly projecting annular ribs which can decrease in size during pinch down to furnish added metal if needed.

The invention permits elimination of one or two internal partitions by means of a novel gas flow tube design wherein a longitudinally extending flange means interconnects an end of the tube and the pinched-down end of the shell. This supports the tube directly on the shell with no need for support by a partition. The flange means may be formed in the tube itself in such a way as to leave gas flow openings in the side of the tube which function also as a means to turn the gas through a 90 angle in the case of a retroverted flow type muffler.

In one embodiment of the invention, a muffler has an inlet tube and a pair of outlet tubes extending parallel to the inlet tube and longitudinal axis of the muffler. It has a tubular metal housing with first and second pinched end walls spaced along the longitudinal axis. The inlet and outlet tubes have, respectively, one end portion that is round to form a gas inlet and a pair of gas outlets to the muffler, the other end portions of the tubes being axially slotted along a plane that is generally parallel to the longitudinal axis to form two axial slots on opposite sides of the tube end. The slotted ends are flattened in a direction transverse to the longitudinal axis to close such other end of each tube and define a pair of side openings axially inward from the flattened end to direct the exhaust gases in a direction laterally of the tube axis.

Preferably, the housing end walls and tube end portions are pinched or flattened simultaneously such that the opposite end walls are compressed about the tube end portions to support the tubes, close the ends of the housing about the gas inlet and gas outlet, define an expansion chamber, and form a contoured exterior. Preferably, the side openings in the tubes are sized to have a total area which is at least equal to or greater than the interior radial cross-sectional area of the tube so that gas volume flow is not restricted, and preferably there are perforations in the tube walls to communicate exhaust gases radially between the tubes and the expansion chamber.

In manufacturing the muffler, material is removed from the opposite side walls forming one end portion of each tube, or both end portions of certain tubes depending on the specific design and, as discussed hereafter, to form in the end portion a pair of axial slots and a pair of axial cantilever wall portions. The cantilever wall portions are pinched or flattened together by a transverse force thereagainst whereby material forming a predetermined end of the wall portions is compressed together in a metal layer joint to close the tube end and the slots are deformed and partially closed to define a pair of side openings in the tube inwardly of the pinched closed end. The ends of the wall portions are then welded together. If desired, to ensure that the side wall openings are of desired size and shape, a shaped forming mandrel can be inserted transversely through the two axial slots and between the two cantilever wall portions, prior to the flattening step, and removed after the flattening step.

The tubes are placed in side-by-side relation in the housing such that the opposite end walls of the housing are transversely aligned with the end portions of the tubes. A forming die flattens the opposite end walls of the housing into closing engagement against the flattened tube ends and about the round gas passage forming tube ends. Alternatively, the end portions of the axially slotted tubes and the tubular housing can be pinched together in one simultaneously initiated forming step whereby like adjacent end portions of the tubes are flattened when the end walls of the housing are flattened thereagainst. Thereafter, the tube end portions and housing end walls are welded together to form an air-tight enclosure seam in the form of a multi layered joint.

Preferably, prior to assembly with the tubes, the muffler housing is provided with a plurality of axially spaced radially outwardly directed annular ribs to enhance strength of the housing. In particular, it is desired to have at least one such annular rib adjacent each end of the housing to provide a "reservoir" of metal and otherwise help in the flow of metal during the pinch-down operations at the ends of the muffler.

Other embodiments of the invention are described hereinafter.

RELATED APPLICATION

U.S. patent application Ser. No. 306,915, filed Feb. 6, 1989 of James R. Abbott, entitled Catalytic Converter with One-Piece Housing, and assigned to the assignee of this application.

DESCRIPTION OF THE DRAWINGS

Further objects and advantages, residing in the construction, arrangement and combination of features in structural parts of the muffler will become apparent from a consideration of the following description with reference to the accompanying drawings in which:

FIG. 1 is a perspective view of a muffler embodying the present invention.

FIG. 2 is a plan longitudinal section view of the muffler of FIG. 1 showing the gas flow tubes.

FIG. 3 is a view taken along line 3—3 of FIG. 2.

FIG. 4 is a cross-section of a round tube from which the housing of FIG. 1 may be formed.

FIG. 7 is an end section of the oval housing taken along line 7—7 of FIG. 6.

FIG. 10 is an end section taken along line 10—10 of the assembly shown in FIG. 9.

FIG. 11 is an end view similar to FIG. 10 after pinch-down of the ends of the muffler housing and the internal gas flow tubes.

FIG. 12 is a view of the step of forming gas flow tubes to be assembled into the muffler housing wherein a pair of forming dies pinch the axially slotted end of the gas flow tube prior to its insertion into the housing of FIG. 8.

FIG. 13 shows the gas flow tube of FIG. 12 having a flattened end and a pair of openings in the side walls thereof.

FIG. 14 is a view of an alternate way of forming the gas flow tube wherein a mandrel is transversely inserted through the axial slots prior to the forming dies pinching the slotted end portion of the tube.

FIG. 15 shows the pinched end of the gas flow tube of FIG. 14.

FIGS. 16 and 17 show in cross-section and perspective views another embodiment embodiment of the present invention in the form of a muffler having a single transverse partition therein.

FIGS. 18–20 show in cross-section and perspective views still another embodiment of the present invention in the form of a muffler having a pair of transverse partitions.

FIGS. 21–22 shown in cross-section and perspective views yet another embodiment of the present invention in the form of a muffler having a pair of transverse partitions and a Helmholtz resonator chamber.

DETAILED DESCRIPTION OF EMBODIMENTS OF THE INVENTION

Figure 5:
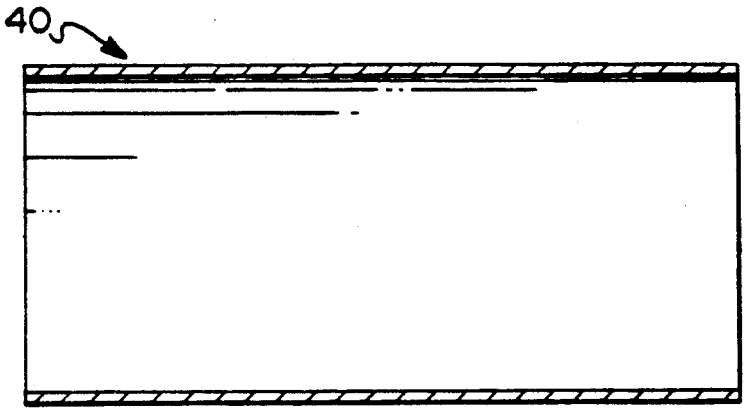
FIG. 5 is a cross-section taken along line 5—5 of the tubular shell shown in FIG. 4.
Figure 6:
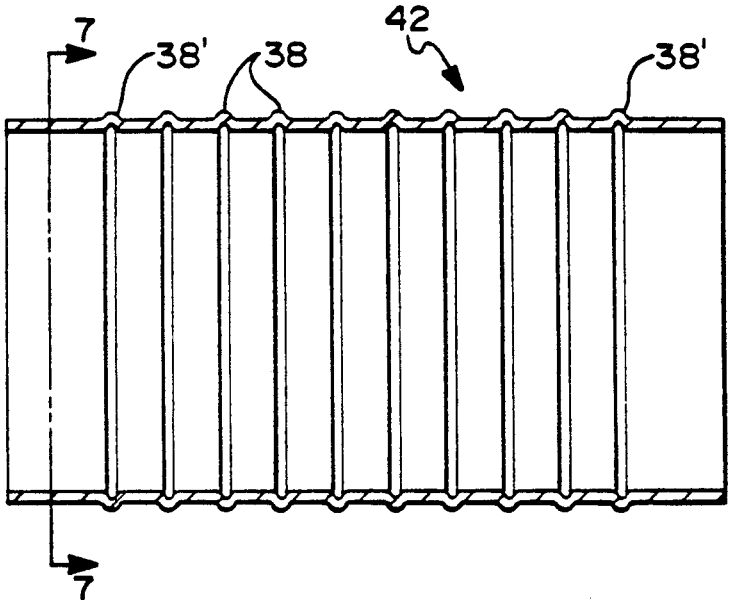
FIG. 6 is a cross-section of the shell shown in FIG. 5 after it has been shaped into an oval housing and formed with transverse, annular, longitudinally spaced, external ribs.

Referring to FIGS. 1–15, a muffler 10 is shown and, in accordance With the invention, has a structure which omits the usual end headers and certain internal partitions as compared with functionally similar mufflers of conventional design. The muffler 10 includes an oval housing or shell 12 of elongated tubular shape which encloses three elongated axially extending tubular gas flow conduits 14, 16 and 18 (e.g., tubes) of circular cross section. The shell and conduits each are fabricated of a metal that may be press-formed or stamped into desired configurations, such as low carbon sheet steel or stainless steel. The shell 12 is preferably symmetrical about its center line or longitudinal axis and has opposite end walls 20 and 22 extending transversely to the longitudinal axis. The conduits 14, 16, and 18 are arranged in the internal expansion chamber 28 defined by the shell to provide a retroverted passage of exhaust gas within the shell and a dual outlet The end walls 20 and 22 of shell 12 comprise opposite sides of the ends of the tubular housing which are pressed or pinched together to form a joint of metal layers and to fit around the end portions of the conduits to support the respective conduits in side by side relation. This forms closures at the shell inlet 24 and shell outlet 26 defining an interior expansion chamber 28 that is sealed by the pressed joint at each end except for the inlet and outlet gas passages provided by tubes 14, 16, and 18.

In the embodiment shown, conduit 14 provides a gas inlet passage for connection to the exhaust system of a combustion engine, this being illustrated by exhaust pipe Pl shown in FIG. 1. Conduits 16 and 18 provide gas outlet passages for communicating acoustically treated exhaust gas to atmosphere or to the tailpipes P2 and P3 of the motor vehicle exhaust system. The gas inlet conduit 14 is coaxial with the housing 12 and disposed midway between the gas outlet conduits 16 and 18 and has a larger diameter than either of the outlet conduits. Other than diameter, each conduit is generally the same and the description for conduit 14 herein will describe conduits 16 and 18, except where specific differences are noted.

Preferably, conduit 14 is generally circular in cross-section and of uniform tubular diameter and includes a first end portion 30 axially spaced from a second end portion 32. End portion 30 is axially slotted and laterally flattened in a manner that the material 31 (FIG. 3) of the tube side wall is pressed or pinched together to form a tube closure at end 30 of the conduit. As a result of the pinching operation, a pair of enlarged teardrop shaped openings 34 are formed in the opposite side walls thereof at a location axially inward of the flattened end. The location of the shaped openings 34 result in the openings being situated within the chamber 28 defined by the housing and operate to receive or discharge exhaust gas. As positioned in the shell, shaped openings 34 cause the exhaust gas to flow in a direction transverse to the tube axis instead of impacting directly onto the shell end wall. End portion 32 is round in cross-section and, depending on the application, is adapted to extend exteriorly of expansion chamber 28 for connection to other parts of the exhaust system.

A central section of the conduit 14 side wall (or side walls of conduits 16 and 18) may be provided with a multiplicity of openings 36 to acoustically interconnect the inside of the tube 14 and the expansion chamber 28 as in the case of corresponding conduits in prior art mufflers. These may be of various sizes, shapes, patterns, and total area and they may, in whole or in part, be in the form of a bank of louvers. The selection is ordinarily made on the basis of the sound, noise, roughness, etc. to be attenuated and the back pressure characteristics desired.

The shell 12 is preferably provided with a plurality of annular ribs 38 spaced longitudinally between the end walls, each rib being disposed in a plane transverse to the longitudinal axis. The ribs extend radially outwardly from and around the shell, each rib being continuous and cooperating to improve the strength and rigidity of the shell 12 and to resist "shell noise". Of particular importance are the endmost separate annular ribs 38' adjacent end walls 20 and 22 of the shell. These are believed to enhance the structural shape retaining capability of the shell 12 when the ends walls are deformed in the pinching or flattening operation in that they provide tube flexibility at the ends and act as sources of metal that may be drawn into the end joints in lieu of undesired deformation elsewhere. The ribs 38' adjacent end walls 20 and 22 appear to limit deformation runout of the shell 12 during the pinching or flattening step.

The housing or shell 12 may be of the desired cross sectional shape, ordinarily round or oval. It may be of seamless tubing (as shown) or lockseamed tubing which is widely used wherein the longitudinal edges of a flat piece of metal rolled up into round or oval shape are overlapped and mechanically crimped or otherwise fastened together to form a round or elliptical tube. The oval or elliptical tube may also be formed of seamless round tubing as illustrated in FIGS. 4–9. A deforming die (not shown) is forced downwardly against the outer periphery of a one-piece round metal shell 40 (FIG. 5) in a plane transversely perpendicular to the longitudinal axis of the shell to form an oval shaped shell 42 (FIG. 6) of elliptical cross-section having a long axis and short axis symmetrically aligned with the longitudinal axis. At an appropriate point in production, ordinarily while the tube is still in the flat metal condition, the wall of shell 42 is deformed so as to provide a plurality of annular ribs 38 and 38' that extend radially outwardly from the shell between each end wall thereof.

Figure 9:
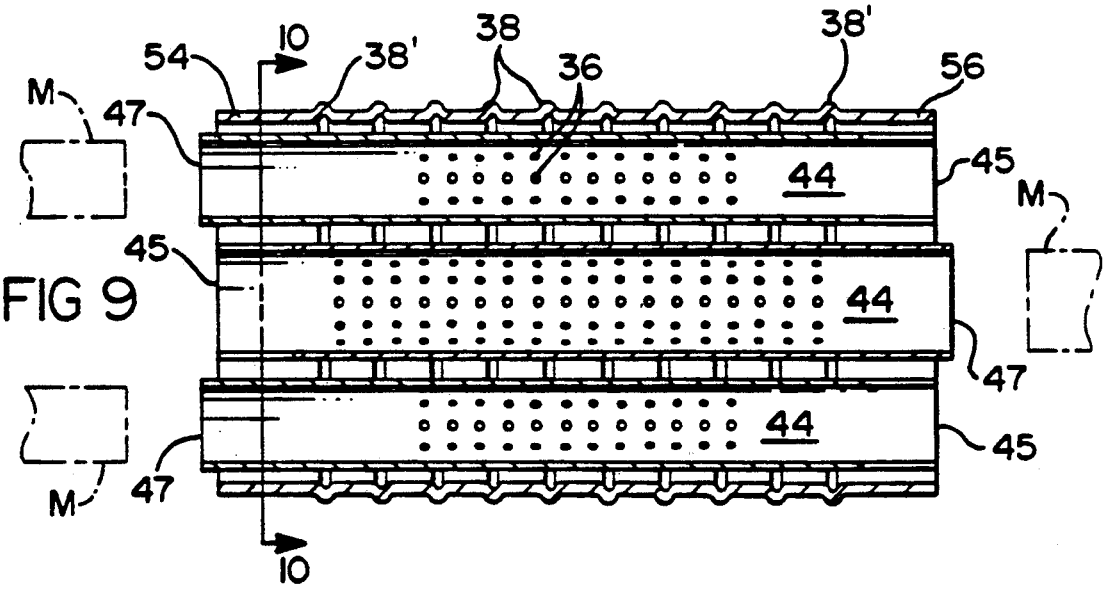
FIG. 9 is a longitudinal plan section view of three gas flow tubes inserted into the muffler housing wherein the tube ends are pinched together simultaneously with pinching the ends of the housing.
Figure 8:
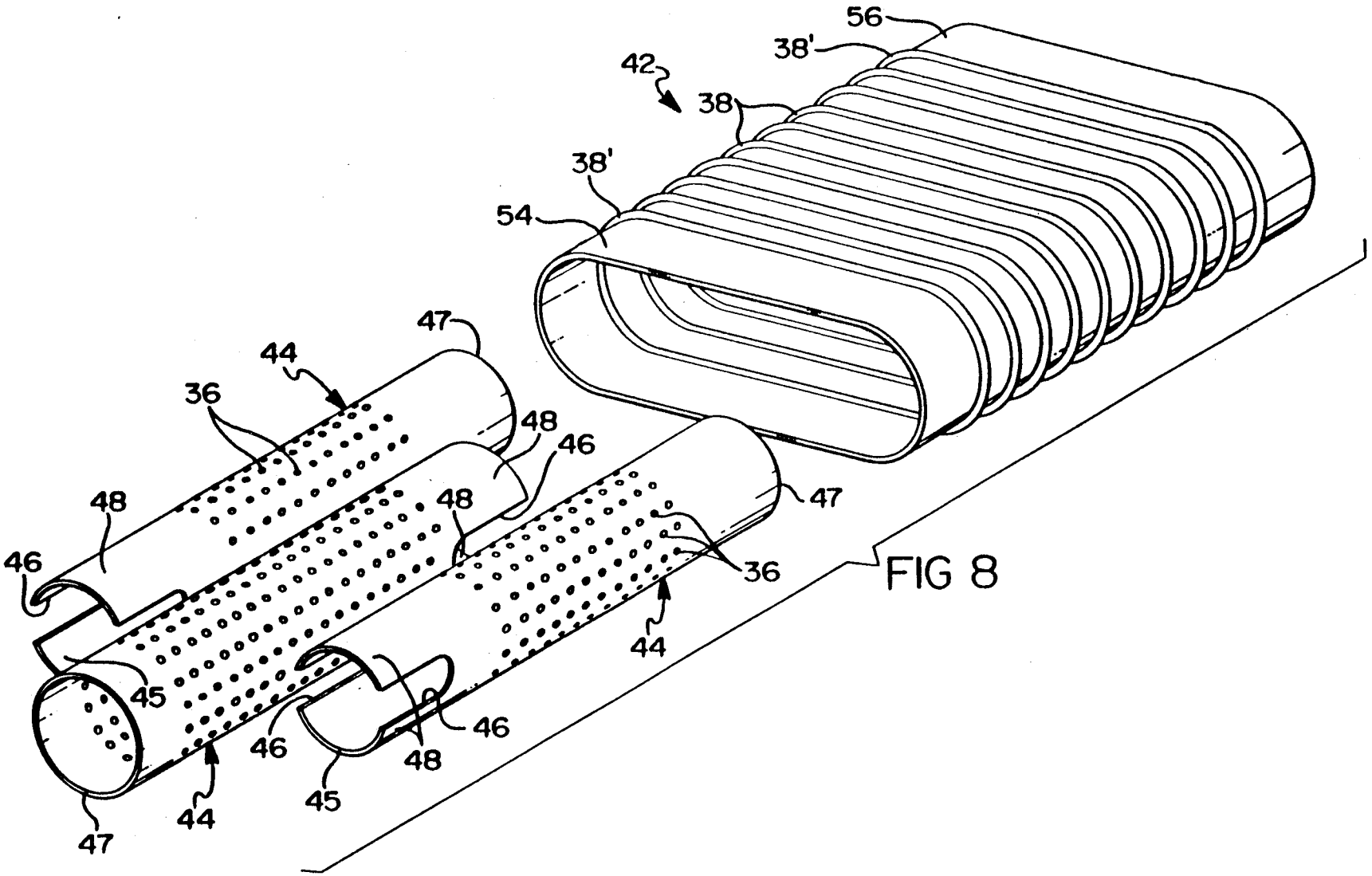
FIG. 8 is an exploded perspective view showing an assembly step in forming the muffler.

Three generally round tubes 44 (corresponding to tubes 14, 16, and 18 and perforated as desired) having opposite ends 45 and 47 each have tube wall material removed from the end 45 thereof in a direction axially inward therefrom to form two enlarged generally U-shaped slots 46 (FIG. 8) and two projecting flange portions 48 of arcuate cross section. The two cantilevered flange portions 48 defined by the two slots 46 extend axially with the slots, being preferably symmetrical on the tube and having an axis which lies in a common plane with the conduit axis. As shown in FIGS. 8 and 9, the three axially slotted conduits 44 are positioned within the oval shell 42 in such manner that the ends 45 and 47 of the conduits 44 are in aligned juxtaposed relation with one another and with the respective end walls 54 and 56 of shell 42.

A cylindrical mandrel M (shown in phantom lines in FIG. 9) is inserted into each of the three gas passage ends 47 of the conduits to maintain the shape of the inlet and outlets thereof. In a single deforming operation the respective end walls 54 and 56 of the shell 40 are flattened by stamping or pressing the opposite sides of the housing ends together and onto and about the end portions of the conduits 44. More particularly, the flange portions 48 of the conduits adjacent the slotted ends 45 are flattened or pinched together by the end walls of the shell as the shell is pinched, whereby the flattened end walls of the conduit and the shell are each disposed in a four metal layer joint that is in a plane which is parallel to and includes the longitudinal axis of the muffler. Along with the pinching together of the ends 45 of the conduits, the deforming step also deforms the end walls 54 and 56 of the shell 40 into mating engagement around the round ends 47 of the conduits to form the inlet and outlets of the muffler. The ends 47 of the conduits are not crushed during the deforming step because they are supported by the mandrels M that were previously inserted therein. After the deforming step is completed, the mandrels M are removed and the metal layered joints formed by the engaged end portions of the shell and conduits are welded together to provide an air-tight expansion chamber 28.

Instead of simultaneous flattening as described above, the axially slotted conduits 44 can alternatively be flattened prior to their insertion into the muffler shell. As seen in FIG. 12, a pair of forming dies D1 and D2 are positioned for movement in a plane perpendicular to the conduit axis whereby to apply a deforming force to the forwardmost end portion of the cantilevered flange portions 48. The forming dies deform or pinch the cantilevered flange portions 48 and compress them into contact with one another along a plane through the tube axis, the flange portions 48 being partially flattened to form a closure at the forwardmost end of the conduit and a pair of teardrop shaped openings 34 in the conduit side wall at a location axially inward of the conduit end as shown in FIG. 13. The flattened conduit ends are then preferably welded together. The pre-pinched conduits 49 (FIG. 13) are then ready for insertion into the shell whereupon the shell end walls are deformed as before into engagement with the conduit end portions 48.

If desired, the openings in the sides of the tubes may be more positively controlled as to size, shape and area. For this purpose, a forming mandrel 58 as shown in FIG. 14 may be inserted in a direction transversely through each of the slots 46 prior to the flattening step. After the pinch-down, the mandrel is removed leaving opening 34' and the conduit so formed (see FIG. 15) may be assembled in a shell.

The total and respective areas of the two openings 34 or 34' in the pinched end portion of each conduit can be selected by the muffler designer and the slots sized accordingly. Ordinarily they will be at least the same as that of the tube to avoid unnecessary increase of back pressure.

In a muffler of ordinary construction corresponding to muffler 10 (FIG. 2), there would be a transverse partition secured inside of housing 12 near but spaced longitudinally in from the inlet (right) end of the housing. It would have three openings in it for the three tubes 14, 16 and 18 and would have collars around the openings welded to the tubes. One partition would provide the only support for the right ends of tubes 16 and 28 and would therefore be necessary. Similarly, there would be a transverse partition near but spaced in from the outlet (left) end of the housing. It would have three openings for the tubes and would be necessary for support of the downstream or left end of inlet tube 14. These two partitions are not needed to support the tubes in a muffler according to the present invention wherein means are provided to support the end of the tube directly on the housing rather than on a partition which is, in turn, supported on the housing. This means preferably takes the form described above in detail where the tube end is slotted and flattened to (a) provide the attachment flanges 48 that engage and are welded to the housing pinch down end joints and (b) provide side openings 34 (and 34') to (1) replace the ordinarily open ends of the gas flow tubes and (2) provide half of the 180 degree gas passage turn-around that occurs when the gas leaves or enters the tube.

In operation as a sound attenuation device, the muffler 10 is mounted in an exhaust gas system as indicated in FIG. 1 so that exhaust gas to be silenced enters the inlet tube 14 (FIG. 2). It flows in the tube to its downstream end where the pinched closed end of the inlet tube forces it to make a 90 degree change of direction to enter the chamber 28 where it continues through another 90 degree change of direction. The two changes amount to a 180 degree reversal of flow and the gas flows through chamber 28 in a reverse direction back toward the inlet end of the muffler. The flow reversals are repeated, in reverse, as the gas enters the side openings 34 (or 34') in the two outlet tubes 16 and 18. The various changes in cross section of the areas through which the gas flow remove acoustic energy and attenuate sound, noise, roughness, spit, whistling, and other undesired sounds in the exhaust gases. Communication of gas from one tube to the chamber 28 and to another tube through perforations or louvers 36 attenuates high frequencies, in particular, while flow of gas between openings 34 and relatively large expansion chamber 28 attenuates medium and lower frequencies.

FIGS. 16 and 17 show another embodiment of the invention wherein a transverse partition is used as is a reverse flow gas tube. As in the previous muffler 10, the two end headers and two internal partitions of the conventional muffler are omitted.

The muffler 60 shown in FIGS. 1 and 17 (along with FIG. 3) has an elongated, annularly ribbed, oval tubular shell 62 with a longitudinal axis and opposite end walls 64 and 66. Shell 62 encloses three axially elongated tubes or gas flow conduits 68, 70 and 72 that are arranged to form a retroverted gas flow passage. The gas flow conduits comprise an inlet conduit 68 having end portions 61 and 63, an outlet conduit 70 having end portions 65 and 67, and a reverse flow conduit 72 having end portions 69 and 71. End portions 61 and 67 are radially enlarged and are connectable in the exhaust system as an inlet and outlet, respectively. The end portions 63 and 75 of conduits 68 and 70 and both end portions 69 and 71 of conduit 72 are each axially slotted and laterally deformed or pinched down to form a pair of gas flow openings (like openings 34 or 34') in the respective opposite side walls of each conduit in the manner described above in connection with conduit 14 of muffler 10.

The opposite end portions of the conduits are in side by side parallel relationship and supported by an adjacent end wall of the shell 62 being flattened thereagainst. The added reverse flow conduit 70 is flattened at both ends in the manner described above. The end portions of the shell and conduits are flattened in the manner described above to form a closure and the flattened ends are welded together. As before, if desired, a central portion of each conduit may be provided with louvers or apertures 36.

A flat transverse partition 74 having a collar 75 around its outer periphery is welded to the interior wall of the shell, such as shown at locations 73 (FIG. 17), whereby the shell 62 is divided into a pair of longitudinally separated expansion chambers 76 and 78 which are also turn-around chambers for directing the gas flow in a direction transverse to the conduit axes. Partition 74 is formed with three apertures also having collars 80 therearound. Aperture collars 80 are respectively sized to receive, support, and be welded to a medial portion of each of the respective gas flow conduits. The flattened end portions 63, 65, 69 and 71 of conduits 68, 70 and 72 are positioned such that inlet conduit 68 has its pair of side openings 34 or 34' disposed in chamber 78, outlet conduit 70 has its pair of openings 34 disposed in chamber 76, and reversing conduit 72 has one of its pair of openings 34 disposed in chamber 76 for receiving the gas flow from the inlet conduit 68 and the other of its pair of openings 34 disposed in chamber 78 for directing the gas flow to the outlet conduit 70.

The outlet conduit 70 is disposed between the inlet and reverse flow conduits 68 and 72. The inlet and outlet conduits 68 and 70 have their inlet and outlet ends 61 and 67 secured, respectively, at the opposite respective end walls 64 and 77 of shell 62. In the embodiment shown, the inlet and reversing conduits are smaller in cross-sectional area than the outlet conduit. Perforations 36, or louvers, disposed in chamber 76 for altering the acoustic characteristics of the mid and upper range frequency noises, may be provided as desired.

The three tubes 68, 70, and 72 may have the ends flattened before or during assembly with the shell 62. In either case they are assembled with the partition 74 and then inserted with it into the shell whereupon the opposite ends of the shell are pinched together, as described in detail above, to produce the flat metal layered pinch down joints 62A at each end.

In operation, exhaust gas enters the muffler at end 61 of inlet tube 68 and flows to the pinched down end of the tube where it is forced to turn through 90 degrees and go through openings 34 (not shown) into chamber 78. This chamber acts as a cross flow and expansion chamber whereby the gas expands as it enters it and then contracts as it enters the side openings 34 (not shown) in reverse flow tube 72. The gas turns another 90 degrees to flow back to the inlet end of the tube 72. The pinched together end of tube 72 forces the gas to turn through 90 degrees and enter expansion and cross flow chamber 76 (by way of side openings 34 which are not shown in FIGS. 16–17). This chamber is larger than chamber 78 and effective in attenuating somewhat lower frequencies. Gas goes from chamber 76 through side openings 34 (not shown) in the pinched down end of the outlet tube 70. The gas then turns another 90 degrees to flow the length of tube 70 and out of the muffler. A wide range of frequencies are attenuated as the gas expands and contracts and flows in the expansion chambers 76 and 78. The transversely aligned banks of perforations on louvers 36 in the tubes 68, 70, and 72 attenuate high frequencies, roughness, and similar noises and sounds and also permit some cross flow and bleeding of the gas in accordance with pressure conditions in the tubes and chamber 76.

FIGS. 18–20 (and FIG. 3) show another embodiment of the invention wherein the end headers and one internal partition are omitted and the muffler has two transverse internal partitions as compared with the no partition first embodiment 10 and the one partition embodiment 60 just described.

The muffler 82 has an elongated, annularly ribbed, tubular shell 84 of oval cross section with a longitudinal axis and opposite end walls 86 and 88. It encloses a perforated, retroverted, gas passage, and a pair of transverse, apertured partitions 90 and 92 each having a collar 93. The gas passage includes an inlet conduit 94, an outlet conduit 96, and a flow reversing conduit 98. The partitions 90 and 92 are welded about the respective outer peripheries of their collars 93 to the inner wall of the shell, such as at 91 and 93' (FIG. 20), and divide the shell chamber into three longitudinally separated chambers 100, 102 and 104.

Partition 90 is formed with three apertures having aperture collars 106 therearound respectively sized to receive, support, position, and be welded to each of the respective conduits. More particularly, partition 90 is welded to an undeformed end portion 108 of inlet conduit 94, and undeformed end portion 110 of reverse flow conduit 98, each of which terminate at partition 90. A medial portion 112 of outlet conduit 96 extends through and is additionally supported by partition 90. The outlet conduit 96 and reverse flow conduit 98, respectively, have axially slotted and laterally flattened end portions 95 and 97, as described for conduit 14, secured by pinched end wall 86 at the shell inlet end. The other, undeformed end 99 of outlet conduit 96 is secured by pinched end wall 88 at the shell outlet end.

Partition 92 includes an aperture having a collar 113 therearound sized to receive, support and be welded to outlet conduit 96. A short cylindrical tuning tube 116 is welded to a collar 114 of a second aperture in partition 92 to communicate with resonator chamber 104.

Chamber 100 is formed by partition 90 in cooperation with the inlet end wall 86 of the shell and defines a cross over chamber for passing exhaust gases transversely between the reverse flow conduit 98 and the outlet conduit 96. Each of the conduits 94, 96 and 98 preferably include a central portion having perforations (corresponding to perforations 36 as previously described) that communicate gas into the chamber 100.

Chamber 102 is disposed centrally of the shell interior for receiving exhaust gases presented thereinto from the undeformed open end 108 of inlet conduit 94 and forms a turnaround chamber for directing gases transversely of the longitudinal axis and into the open end 110 of the flow reverse flow conduit 98. Chamber 104 is formed by the second partition 92 in cooperation with the pinched down outlet end wall 88 of the shell and defines a resonator chamber for attenuating low frequency sound. Tuning tube 116 is on the axis of tube 108 and the longitudinal axis of the muffler and is the only gas passage that communicates gas from chamber 102 and tube 108 into the chamber.

The volume of chamber 104 along with the length and diameter of the tube 116 may be interrelated in accordance with the Helmholtz formula to tune them to attenuate a specific low frequency.

The internal structure of muffler 82 is very similar to that of a conventional tri-flow type muffler. However, in muffler 82 an internal partition that would be used at the inlet end of the housing to support the tubes is omitted.

Partition 90 may be provided with a plurality of ports 118 around the inlet conduit, four being shown in the preferred embodiment herewith. These ports permit some axial flow between adjacent chambers.

The housing 84 of muffler 82, like the housings of mufflers 10 (FIGS. 1–15) and 60 (FIGS. 16–17), is unique in construction and in the pinch-down ends to the present invention. The housing features, having been described above, are not repeated here but they are a preferred and important part of muffler 82 as they are of mufflers 10 and 60. Similarly, the methods of construction described above for muffler 10 may be followed for muffler 82, as well as muffler 60.

In operation of muffler 82, exhaust gas enters the inlet tube 94 and flows out of its open end into turn-around chamber 102 formed by and between partitions 90 and 92. It enters the open end of reverse flow tube 98 and flows back to the inlet end of the muffler. The pinched down end of the tube 98 forces gas to leave the tube through the side openings 34 or 34' (not shown FIGS. 18–10). It enters expansion chamber 100 and crosses over to enter the side openings 34 or 34' (not shown) in outlet tube 96. In tube 96 it flows out of the muffler. Acoustically, the muffler 82 operates like a tri-flow muffler. A selected low frequency can be attenuated by he combination of tuning tube 116 and chamber 104 for which tube 116 provides the only inlet and outlet. The remaining structure provides means effective to attenuate a wide range of frequencies and objectionable sound in the gas as will be recognized by those familiar with exhaust gas mufflers.

Muffler 120 of FIGS. 21–22 (and FIG. 3) has two internal partitions and is similar to muffler 82, just described. However, in muffler 120 the reverse flow tube 142 extends the full length of the housing 122 and is slotted and pinched down at both ends and affixed to the pinch-down joints of the housing 122 at both the inlet and outlet ends. It therefore acts as a load-carrying structural member to strengthen the housing and the entire muffler.

The muffler 120 of FIGS. 21 and 22 has an elongated, annularly ribbed, elliptical tubular shell 122 that encloses a perforated retroverted gas flow passage. Muffler 120 further comprises two partitions 124 and 126 which divide the interior chamber formed between the inlet and outlet end walls 128 and 130 of the shell into first, second and third chambers 132, 134 and 136. The gas flow passage includes an inlet conduit 138 having an inlet 140 extending through end wall 128 and an outlet end 154, a reverse flow conduit 142 having opposite ends 144 and 146 pinched down and secured by end walls 128 and 130 of the housing 122 and an outlet conduit 148 having a pinch down end 150 secured by housing end wall 128 and an outlet 152 extending through housing end wall 130. The conduits are generally circular in cross section with ends 144, 146, and 150 being pinched (i.e., flattened) to form closures as discussed above. The ends 144 and 150 of reverse flow conduit 140 and outlet conduit 148 are provided with teardrop shaped openings 34 (not shown in FIGS. 21–22) to communicate gases into and out of chamber 132 adjacent inlet end wall 128. Each gas flow conduit has an intermediate portion thereof perforated by apertures 36 whereby a portion of the gases can communicate in a direction radially of the tubes into chamber 132 to further assist in gas expansion and sound attenuation.

Partition 124 is formed with three apertures having aperture collars 156 therearound respectively sized to receive, support, position, and be welded to each of the respective conduits. More particularly, partition 124 is welded to undeformed end 154 of inlet conduit 138 which terminates at partition 124 to discharge exhaust gases into central turn around chamber 134. Partition 124 is further welded to a medial portion of outlet conduit 148 and reverse flow conduit 142 which each extend between opposite end walls 128 and 130. In this manner partition 124 also serves to provide support to central portions of conduits 148 and 142.

Partition 126 has three apertures having aperture collar 127 therearound respectively sized to receive, support, position, and be welded to reverse flow conduit 142, outlet conduit 148, and a tuning tube 158 which communicates with resonator chamber 136. The chamber 136 formed by partition 126 and end wall 130 of shell 122 in conjunction with tube 158 comprises a Helmholtz resonator chamber for attenuating a selected low frequency sound. Partitions 124 and 126 each have collars extending around the periphery thereof for welding the partitions to the shell 122 at points 151 and 153, respectively, as shown on FIG. 22.

Four circumferentially spaced circular openings 160 are formed in the side wall of reverse flow conduit 142 between the opposite end portions 144 and 146 thereof, the openings being positioned in the center chamber 134 and between partitions 124 and 126. Openings 160 are adapted to receive exhaust gas from inlet conduit 138 for reversing the flow of gas through conduit 142, into chamber 132 and out of muffler 120 through outlet conduit 148.

Except for the reverse flow tubes 98 (FIG. 18) and 142 (FIG. 21), the mufflers 82 and 120 are very similar in construction and the description of muffler 82 applies to muffler 120. The tube 142 in muffler 120, however, is welded at each end to the housing 122 and acts as a structural load-carrying member to strengthen the housing and muffler. It is preferable that the cutout (not shown) at the end 146 be shaped to leave no opening at all in the side wall of tube 142 when the tube end is pinched down. If this is done, the tube 158 is the only inlet and outlet to chamber 136 and it can function as a Helmholtz resonator in accordance with the Helmholtz tuning formula. However, if there is an opening in tube 142 in chamber 136 the Helmholtz relationship no longer applies because there can be flow in the chamber 136 by way of this opening as well as the tube 158. In this circumstance, the chamber 136 will not be as effective on a single, selected low frequency but is likely to be broad-banded and attenuate a wider range of relatively low frequencies.

Modifications of the specific embodiments described herein may be made without departing from the spirit and scope of the present invention.

What we claim is:

1. A muffler for use in a motor exhaust system, said muffler comprising a closed tubular oval-shaped shell having opposite ends and an interior chamber, and gas passage means in said interior chamber for passing exhaust gases between the ends of the shell, said passage means comprising axially elongated inlet and outlet tubes with longitudinal axes disposed in side-by-side relation, each of said tubes being formed by a metal wall having first and second end portions located at opposite ends of said shell, each of said first end portions being generally round in cross-section, the metal forming each of said second end portions being axially slotted and laterally flattened in a direction transverse to the longitudinal axis of the tube and pressed into contact whereby to complete closed the tube end and form a pair of side openings in the tube at a location axially inward of the closed tube end, said openings being sufficient to pass the exhaust gases in a direction transverse of said tube axis.

2. The muffler as recited in claim 1 wherein said shell has a longitudinal axis and first and second end walls at its opposite longitudinal ends, and the metal comprising said first and second end walls of said shell, respectively, is deformed into engagement so as to form a double metal layer end closure with the outer periphery of said first and second end portions of said tubes to support said inlet tube and said outlet tube and to close the ends of said shell.

3. The muffler as recited in claim 1 wherein each of said second end portions is axially slotted by a pair of axial slots extending form the end of the tube axially inward to define a pair of axially extending wall portions which are deformably pressed together and flattened whereby to close the tube ned and form said openings axially inwardly of the closed end.

4. The muffler as recited in claim 1 wherein each of said inlet and outlet tubes define a first path direction for the exhaust gas to flow between the inlet and outlet end of the shell and said openings in the side walls of said tubes are positioned to compel the exhaust gas to reverse its direction and flow from the outlet end to the inlet end of said shell.

5. The muffler as recited in claim 1 wherein said passage means comprises a pair of outlet tubes, said flattened second end portion of each said outlet tube being juxtaposed with said first end portion of said inlet tube.

6. The muffler as recited in claim 5 wherein said inlet tube is disposed between said outlet tubes.

7. The muffler as recited in claim 1 wherein a predetermined axial end portion of each of the respective opposite end walls of said shell is flattened against a respective axial end portion of said second end portions of said tubes, said flattened together portions being disposed in a plane that is parallel to said longitudinal axis of said tubes.

8. The muffler as recited in claim 7 wherein the flattened portions of said shell end walls and said tube end portions are in a common plane which includes said longitudinal axis.

9. The muffler as recited in claim 1 wherein said shell has transverse end walls adjacent the opposite inlet and outlet ends of said shell, one said end wall being compressively deformed into engagement about one of said first end portion of said inlet tube and forming an inlet opening encircling said first end portion of the inlet tube, and the other said end wall being compressively deformed into engagement about said first end portion of said outlet tube and forming an outlet opening encircling said first end portion of the outlet tube.

10. The muffler as recited in claim 1 wherein said shell has a longitudinal axis and is generally oval shaped and defined by a cross-section having long and short axes orthogonal to the longitudinal axis of said shell, and said end walls of said shell are deformably contoured such that a portion of each is in a plane generally including said long axis.

11. The muffler as recited in claim 1 wherein an annular rib in the shell extends radially outwardly from said shell adjacent to each said end wall.

12. The muffler as recited in claim 1 wherein said shell is generally contoured and oval in cross section, and comprises a plurality of ribs spaced longitudinally between said end walls, each said rib being disposed in a respective plane transverse to said longitudinal axis.

13. The muffler as recited in claim 12 wherein said ribs extend radially outwardly from and around said shell, each said rib being continuous.

14. The muffler as recited in claim 11 wherein said annular rib is integrally formed from the material of said shell.

15. A muffler for a motor exhaust system, said muffler comprising a longitudinal metal shell having first and second end walls, three generally round metal inlet and outlet conduits, each of said conduits having opposite end portions juxtaposed, respectively, with one another and with the opposite respective first and second end walls of said shell, and engagement means integrally formed with said shell for engaging each of said first and second end portions of said conduits whereby to support each of said conduits in retroverted side-by-side relation and for closing the opposite ends of said shell whereby to form an interior expansion chamber, said inlet conduit having one end portion thereof connectable to said exhaust system, said outlet conduit having one end portion thereof for discharging gases to the atmosphere, and each of the other end portions of said conduits being partially closed by material thereof begin pinched together and flattened into engagement whereby to form a closed end and having two side openings at a location axially inward of its closed end for compelling gases to flow in a direction transverse to said longitudinal axis of said shell.

16. The muffler as recited in claim 15 wherein said engagement means comprises each of said end walls of said shell being deformed in a direction transverse to said longitudinal axis to close around each of said end portions without deforming each of said one end portions of said inlet and outlet conduits.

17. The muffler as recited in claim 15 including annular rib means adjacent each of said end walls for facilitating deformation of each of said end walls.

18. An acoustic muffler through which exhaust gas form a combustion engine passes on its way to the atmosphere, said muffler comprising an elongated tubular shell having opposite longitudinal end walls pinched together to form a closed space inside the shell, an inlet tube, and an outlet tube, each of said tubes being substantially cylindrical in cross-section and having axially spaced first and second end portions and associated first and second ends, each of said first end portions begin secured by the pinched end walls of said shell and defining, respectively, an exhaust gas inlet connectable to the engine exhaust system for receiving the exhaust gas from the engine and an exhaust gas outlet connectable to a tailpipe for discharging the exhaust gas to the atmosphere, and each of said second end portions communicating with said space, at least one of said second end portions having an end wall that is axially slotted and deformably pinched adjacent to its second end whereby to form axially extending flattened wall portions which are pressed into contact with one another whereby to close the tube end and define a pair of shaped openings inwardly of said closed tube end which will compel the exhaust gases to pass in a direction transverse to the tube axis.

19. The muffler as recited in claim 18 wherein each of said second end portions of each of said tubes are of like construction.

20. The muffler as recited in claim 18 further comprising a pair of outlet tubes, each of said outlet tubes having said first and second end portions, and each of said second end portions being provided with a pair of said shaped openings for receiving gas directed thereto from said inlet tube.

21. The muffler as recited in claim 18 further comprising a partition enclosed by said shell to longitudinally divide said closed space into two separate chambers, and reverse flow means for communicating said exhaust gas between each of said second end portions of each of said inlet and outlet conduits through each of said two chambers.

22. The muffler as recited in claim 21 wherein a respective medial portion of each said inlet tube and said outlet tube is disposed in one of said two separate chambers, each of said medial portions being provided with a plurality of apertures which communicate gas in a direction radially outwardly from the respective tube.

23. The muffler as recited in claim 22 wherein said reverse flow means comprises an elongated reversing tube having its opposite end portions flattened and secured by the respective pinched end walls of said shell, and each said end being closed and formed with shaped openings substantially similar at least one in said second end portion, a medial portion of said reverse flow tube being disposed in said one of said two separate chambers and provided with a plurality of apertures which communicate gas radially outwardly therefrom.

24. The muffler as recited in claim 21 wherein a respective medial portion of each said inlet and outlet tubes has a medial portion thereof disposed in one of said chambers, each said medial portion being provided with a plurality of radially outwardly extending louvers which communicate gas in a direction transverse to the longitudinal axis of said shell.

25. The muffler as recited in claim 18 further comprising gas turn around means for reversing the axial direction of gas flow when passed from said inlet tube to said outlet tube.

26. The muffler as recited in claim 25 wherein said turn around means comprises a partition dividing said closed space into a pair of chambers, and an axially elongated reverse flow tube supported by the partition and having opposite first and second end portions axially slotted and flattened to form at each end of the reverse flow tube an end closure and a pair of side openings to communicate gases in a direction transversely of the tube axis, the respective end portions of said reverse flow tube receiving exhaust gas from said inlet tube in one said chamber and discharging exhaust gas to said outlet tube in the other said resonator chamber.

27. The muffler as recited in claim 18 wherein said second end portion of each said inlet tube and outlet tube is reduced in cross-section to form a smooth transition between said pressed and said undeformed end portions.

28. The muffler as recited in claim 18 wherein each of said tubes are substantially of equal length and said pressed end portions are grippingly engaged by said opposite end walls of said shell being deformed in engagement therewith.

29. The muffler as recited in claim 18 including support means, integral with said shell, for supporting said tubes in side by side relation.

30. The muffler as recited in claim 25 wherein said turn around means comprises a reverse flow tube having a first end portion secured by said inlet end wall and a second end portion, said tube having openings formed in said first end portion, said muffler further comprising a first and a second partition secured around their respective outer peripheries to the inner wall of said shell, said partitions being longitudinally spaced to partition said closed chamber of said shell into first, second, and third chambers, said second chamber defining a turnaround chamber to direct exhaust gas between said second end portion of said inlet tube and said second end portion of said reverse flow tube in a direction transverse to the longitudinal axes of said tubes, said first chamber being adjacent said inlet end wall of said shell and defining a turnaround chamber to direct exhaust gas between said first end portions of said reverse flow tube and said outlet tube in a direction transverse to the longitudinal axes of said tubes.

31. The muffler a recited in claim 30 wherein said second partition includes a tuning tube for communicating gas from said second to said third chamber, said third chamber forming a Helmholtz resonator chamber with said tuning tube.

32. The muffler as recited in claim 30 further comprising apertures located in said partitions and collar means associated with said apertures in said first partition for receiving and securing a portion of said inlet, outlet, and reversing tubes.

33. The muffler as recited in claim 31 wherein said tuning tube and said inlet tube are disposed in a common plane including the longitudinal axis of said shell.

34. The muffler a recited in claim 33 wherein said tuning tube and said inlet tube are generally concentric with said longitudinal axis of said shell.

35. The muffler as recited in claim 30 including means associated with said first partition and said first and second chambers for attenuating mid-range sound frequencies.

36. The muffler as recited in claim 35 wherein said attenuating means comprises a plurality of openings provided in said first partition whereby exhaust gases are permitted to communicate directly between said first and said second chambers.

37. The muffler as recited in claim 18 further comprising rib means adjacent each end wall of said shell for facilitating pinch-down of the cross-section of said shell at each end of the shell.

38. The muffler as recited in claim 37 wherein said rib means comprises a plurality of longitudinally spaced ribs each extending radially outwardly from said shell and each extending continuously around said shell.

39. The muffler as recited in claim 30 wherein said reverse flow tube extends between the opposite end walls of said shell and said second end portion of said reverse flow tube includes a medial portion provided with a plurality of openings for receiving gas in said second chamber, said reverse flow tube including a pinched end secured by said outlet end wall.

40. A muffler for silencing the exhaust gas from a combustion engine, said muffler comprising a shell of elongated tubular shape having a longitudinal axis and opposite ends extending transversely to said axis, and gas passage means comprising a plurality of tube sections adjacent the ends of the shell which collectively define a retroverted passage for passing exhaust gases through the shell, each of said tube sections including an inlet section, an outlet section, and a closure section for changing the direction of said gas flow, each of said closure sections having an axially slotted end portion deformably pinched such that the material thereof is compressed together to close the end of said section and the axial slots are partially laterally deformed to form a pair of openings axially inward from the closed end for communicating gas in a direction transverse to said longitudinal axis.

41. The muffler as recited in claim 40 wherein said shell is of oval shaped contour, and said muffler further comprises engagement means integral with said shell and engaging said inlet section, outlet section, and closure sections for supporting said tube sections and for closing said ends of said shell to form an interior expansion chamber enclosing said passage means, said engagement means comprising the end walls of said shell being pinched together and about the respective exteriors of said inlet section, outlet section, and closure section.

42. The muffler as recited in claim 40 wherein said passage means comprises a tubular first conduit including said inlet section and one said closure section, a tubular second conduit including said outlet section and one said closure section, and a tubular third conduit including one said closure at each of its opposite end portions, the end walls of said shell forming engagement means for supporting each of said sections in side-by-side relation and for closing said shell to form an interior expansion chamber therein.

43. The muffler as recited in claim 42 wherein said end walls of said shell and said inlet, said outlet, and said closure sections of each of said conduits are deformed in place to close said shell about each of said sections and firmly secure said sections to said shell.

44. A gas flow conduit for use in apparatus for silencing exhaust gases from a combustion engine, said conduit comprising a generally round tubular wall of metal having an inlet end portion and an outlet end portion spaced along a longitudinal axis, wherein material forming said wall of at least one said end portion is axially slotted and deformably pressed together to close the end thereof and form a closure with a pair of openings axially inward of the closure for directing gas to flow in a direction transversely of said longitudinal axis.

45. The gas flow conduit as recited in claim 44 wherein the openings are generally teardrop in shape.

46. The gas flow conduit as recited in claim 44 wherein said wall forming said end portion is slotted from the end thereof axially inward to define a pair of axial cantilevered portions which form said openings when said material is pressed together.

47. The gas flow conduit as recited in claim 46 wherein the material forming the other of said end portions is slotted and deformed in like fashion as said one end portion whereby both ends of said conduit are closed and said end portions are each provided with a pair of side openings axially inward of the respective conduit end for directing gas to flow in a direction transversely of said longitudinal axis.

48. The gas flow conduit as recited in claim 44 wherein said deformed end portion and said longitudinal axis are disposed in a common plane.

49. The gas flow conduit as recited in claim 44 wherein the area, size, and shape of said side openings and the cross-sectional area of said conduit in its undeformed state are each preselected to have a desired area, size, shape, and relationship to one another.

50. The gas flow conduit as recited in claim 44 wherein a plurality of small apertures are provided in said side wall of said conduit to allow gas to travel through said wall in a radial direction.

51. The gas flow conduit as recited in claim 44 wherein said openings are spaced from the exterior surface of the undeformed portion of said conduit.

52. A muffler for silencing a gas flowing from a combustion engine, comprising an elongated tubular shell having a longitudinal axis and an inlet end and an outlet end spaced along said longitudinal axis, closure means integral with said shell for closing the ends of said shell to form an interior space, perforated flow directing means arranged within said space to provide flow paths of varying length and direction over which the gas may flow in passing between said ends, said flow directing means including an inlet conduit having a first end portion connectable to said gas discharged from said engine and a second end portion opening in said space, a reverse flow conduit having opposite first and second end portions opening in said space, and an outlet conduit having a first end portion opening in said space and a second end portion to discharge said gas to atmosphere, and partition means for dividing said space into two longitudinally spaced chambers, one said chamber being adjacent said inlet end and the other said chamber being adjacent said outlet end, said first end portions of said conduits being juxtaposed in one said chamber and adjacent said inlet end, said first end portion of said reverse flow conduit and of said outlet conduit each being closed by the material forming the side wall of said conduit being pinched together whereby a pair of gas flow openings are provided in the side walls thereof for directing said gas laterally of the conduit axis and into or out of said one chamber.

53. The muffler as recited in claim 52 further comprising a means for closing said first end portions of said outlet and said reverse flow conduits wherein said means includes support means for supporting said first and second end portions of said outlet and said reverse flow conduits.

54. The muffler as recited in claim 52 wherein said wall of each said conduit includes a plurality of apertures for communicating gas radially of said conduit axis and into said one chamber.

55. The muffler as recited in claim 52 wherein said partition means comprises a partition having three collared apertures through which the said inlet, outlet, and reverse conduits pass.

56. The muffler as recited in claim 52 wherein said partition means comprises a first and a second partition, said first and second partitions dividing the interior of said shell into first, second and third chambers, said first chamber being adjacent to said inlet end of said shell and said third chamber being adjacent to said outlet end of said shell.

57. The muffler as recited in claim 56 wherein said second partition includes a tuning tube that provides the only means of communicating said gas from said second chamber into said third chamber, wherein the dimensions of said tuning chamber are predetermined to optimize attenuation of low frequency sound.

58. The muffler as recited in claim 56 wherein said first partition includes a plurality of small ports which communicate gases longitudinally between said first and said second chambers, wherein the dimensions of said small ports are predetermined to optimize attenuation.

59. The muffler as recited in claim 57 wherein the axes of said tuning tube and said inlet conduit are generally coaxially aligned.

60. The muffler as recited in claim 58 wherein said axes of said tuning tube and said inlet conduit are generally coaxially aligned with said longitudinal axis of said muffler.

61. The muffler as recited in claim 58 wherein opposite end portions of said reverse flow tube are secured by said end walls of said shell, said reverse flow tube includes a plurality of round openings for communicating gases radially into said second chamber, and said second end portion of said reverse flow tube has no openings therein and is secured to said outlet end of said shell.

62. An acoustic muffler of the type used in an exhaust gas system comprising a one-piece sheet metal housing of elongated tubular shape and having a longitudinal axis and opposite ends extending transversely to said longitudinal axis, one of said ends being an exhaust gas inlet end for the muffler and the other of said ends being an exhaust gas outlet end for the muffler, said housing metal at said inlet end being flattened to form an inlet joint of metal layers that provides an inlet end closure of the inlet end of the housing, said inlet end closure having a gas inlet passage for gas to flow into the housing, said housing metal at said outlet end being flattened to form an outlet joint of metal layers that provide and outlet end closure for the outlet end of the housing, said outlet end closure having a gas outlet passage for gas to flow out of the housing, said end closure serving to seal the opposite ends of the muffler housing except for said gas inlet and a gas outlet passages, a gas flow conduit inside said housing, and flange means on said gas flow conduit having an end portion fitting between the layers of one of said joints whereby this joint supports the flange means and the flange means supports the conduit.

63. An acoustic muffler for an exhaust gas system, said muffler comprising a one-piece sheet metal housing of elongated tubular shape and oval cross-section to devine a first and second pair of opposite sides, said housing having a longitudinal axis and opposite ends extending transversely to said longitudinal axis, one of said ends being an exhaust gas inlet end for the muffler and the outer of said end being an exhaust gas outlet end for the muffler, said first pair of opposite sides of said housing at said inlet end being in engagement with one other to form an inlet joint of metal layers that provides an inlet end closure for the inlet end of the housing, said inlet end closure having a gas inlet passage for gas to flow into the housing, said second pair of opposite sides of said housing at said outlet end being in engagement with one other to from an outlet joint of metal layers that provides an outlet end closure for the outlet end of the housing, said outlet end closure having a gas outlet passage for gas to flow out of the housing, said end closures being formed by the metal of said sheet metal housing and serving to seal the opposite ends of the muffler housing except for said gas inlet and gas outlet passages, and an annular radially outwardly extending rib formed in said housing, said rib being located adjacent to the end of the housing and extending transversely to said longitudinal axis.

64. An acoustic muffler for an exhaust gas system, said muffler comprising a one-piece sheet metal housing of elongated tubular shape, said housing having a longitudinal axis and end walls at the opposite end extending transversely to said longitudinal axis, one of said ends being the exhaust gas inlet end for the muffler and the other of said ends being the exhaust gas outlet end for the muffler, the metal of said housing at said inlet end being pressed together to close the ends and to form an inlet joint of metal layers that provides an inlet end closure for the inlet end of the housing, said inlet end closure having a gas inlet passage for a gas to flow into the housing, the metal of said housing at said outlet end being pressed together to close the ends and to form an outlet joint of metal layers that provides an outlet end closure for the outlet end of the housing, said outlet end closure having a gas outlet passage for gas to flow out of the housing, said end closures serving to seal the opposite ends of the muffler housing except for said gas inlet and gas outlet passages, a gas flow conduit inside said housing, flange means on said conduit having an end portion fitting between the layers of one of said joints whereby this one joint supports the flange means and the flange means supports the conduct, and an annular radial outwardly extending rib formed in said housing, said rib being located at the end of the housing and extending transversely to said longitudinal axis.

65. An acoustic muffler for an exhaust gas system, said muffler comprising a housing of elongated tubular shape and having a longitudinal axis, an inlet end closure for the inlet end of the housing and having a gas inlet passage for gas to flow into the housing, an outlet end closure for the outlet end of the housing having a gas outlet passage for gas to flow out of the housing, a gas flow tube inside said housing having a gas flow portion and a laterally flattened flange to extend axially beyond said gas flow portion, said flange being affixed to one of the end closures of said housing whereby the tube is supported directly on the housing.

66. A muffler as set forth in claim 65 including a gas flow opening formed in the gas flow portion of said tube adjacent said flange and providing for gas flow transversely to the length of the tube.

67. A muffler for an exhaust system comprising a shell having a longitudinal axis and end walls at its opposite ends, three generally cylindrical inlet and outlet conduits with each of said conduits having its opposite respective end portions juxtaposed with one another and with the opposite respective ends of said shell, engagement means integrally formed by the end walls of said shell for engaging each of said end portions of said conduits whereby to support each of said conduits in retroverted side-by-side relation and for closing the opposite ends of said shell whereby to form an interior expansion chamber, said inlet conduits having one of its end portions connectable to said exhaust system, said outlet conduit having one of its end portions for discharging gases to the atmosphere, and the other end portions of said conduits, respectively, including an end, and a pair of slots extending axially inwardly form the respective end of the conduit, the end of each of said other end portions being completely closed by the material thereof being pinched into engagement and flattened in a direction transverse to the direction of said axially extending slots whereby to form a double layer end closure extending transversely to the longitudinal axis of the conduit and completely closing the longitudinal end of the conduit, and said slots being closed adjacent to the conduit end whereby to form two side openings at a location axially inward of the conduit end closure for directing gases to flow in a direction transverse to the longitudinal axis of the shell.

68. A gas flow conduit for sue in apparatus for silencing exhaust gases from a combustion engine, said conduit comprising a generally round tubular wall of metal extending between inlet and outlet end spaced along a longitudinal axis and having an inlet end portion for receiving said exhaust gases and an outlet end portion for directing said exhaust gases in a direction transverse to said longitudinal axis, the metal forming the tubular wall of said outlet end portion being axially slotted and deformably flattened to completely close the end of said outlet end portion whereby to form a complete end closure thereat and the axially slotted metal forming a pair of openings axially inward of the flattened end closure for directing gas to flow in a direction transversely of said longitudinal axis.

* * * * *

UNITED STATES PATENT AND TRADEMARK OFFICE

CERTIFICATE OF CORRECTION

PATENT NO. : 5,187,334

DATED : February 16, 1993

INVENTOR(S) : James R. Abbott, et al

It is certified that error appears in the above-indentified patent and that said Letters Patent is hereby corrected as shown below:

Column 1, line 17, After "pieces" insert --.--.
Column 1, line 46, "factor" should be --factory--.
Column 1, line 63, "90" should be --90°--.
Column 3, line 58, Delete "embodiment" (2nd occurrence).
Column 4, line 5, "With" should be --with--.
Column 4, line 21, After "outlet" insert --.--.
Column 7, line 38, "1" should be --16--.
Column 10, line 14, before "Figs." insert --in--.
Column 10, line 20, "he" should be --the--.
Column 11, line 6, "collar"should be --collars--.
Column 12, line 12, Claim 3, "form" should be --from--.
Column 12, line 15, Claim 3, "ned" should be --end--.
Column 13, line 39, Claim 18, "form" should be --from--.
Column 13, line 46, Claim 18, "begin" should be --being--.
Column 18, line 21, Claim 62, "and" should be --an--.
Column 18, line 24, Claim 62, "closure" should be --closures--.
Column 18, line 34, Claim 63, "devine" should be --define--.
Column 18, line 38, Claim 63, "outer" should be --other--.
Column 18, line 38, Claim 63, "end" (1st occurence) should be --ends--.
Column 18, line 46, Claim 63, "from" should be --form--.
Column 18, line 60, Claim 64, "end" (2nd occurrence) should be --ends--.
Column 19, line 2, Claim 64, "ends" should be --end--.
Column 19, line 12, Claim 64, "conduct" should be --conduit--.
Column 19, line 13, Claim 64, "radial" should be --radially--.
Column 20, line 10, Claim 67, "form" should be --from--.

UNITED STATES PATENT AND TRADEMARK OFFICE

CERTIFICATE OF CORRECTION

PATENT NO. : 5,187,334

DATED : February 16, 1993

INVENTOR(S) : James R. Abbott, et al

It is certified that error appears in the above-indentified patent and that said Letters Patent is hereby corrected as shown below:

Column 20, line 23, Claim 68, "sue" should be —use—.

Signed and Sealed this

Fourteenth Day of December, 1993

Bruce Lehman

*Attest:*

BRUCE LEHMAN

*Attesting Officer*

*Commissioner of Patents and Trademarks*